US012465180B1

(12) United States Patent
McIntosh

(10) Patent No.: US 12,465,180 B1
(45) Date of Patent: Nov. 11, 2025

(54) MULTI-FUNCTION WASHCLOTH MITT

(71) Applicant: Amanda McIntosh, Altadena, CA (US)

(72) Inventor: Amanda McIntosh, Altadena, CA (US)

( * ) Notice: Subject to any disclaimer, the term of this patent is extended or adjusted under 35 U.S.C. 154(b) by 355 days.

(21) Appl. No.: 16/998,136

(22) Filed: Aug. 20, 2020

Related U.S. Application Data

(63) Continuation of application No. 15/664,066, filed on Jul. 31, 2017, now abandoned.

(60) Provisional application No. 62/369,117, filed on Jul. 31, 2016.

(51) Int. Cl.
*A47K 7/02* (2006.01)
*A45D 44/00* (2006.01)

(52) U.S. Cl.
CPC ..... *A47K 7/02* (2013.01); *A45D 44/00* (2013.01)

(58) Field of Classification Search
CPC ... A47K 7/02; A47L 13/18; A45D 2200/1054; A45D 2200/1063; A45D 44/00
See application file for complete search history.

(56) References Cited

U.S. PATENT DOCUMENTS 1,091,880 A 3/1914 Diamond
1,495,389 A 5/1924 Heimerl et al.
2,179,614 A 11/1939 Cohen
2,431,433 A 11/1947 Solakian et al.
2,621,784 A * 12/1952 Boytham ..... A45D 33/34 156/716
3,472,242 A * 10/1969 Howard ..... A61Q 1/14 D28/8
3,596,661 A * 8/1971 Motz ..... A45D 34/04 604/290
3,711,889 A 1/1973 Jennings
4,071,921 A 2/1978 Jury
4,932,095 A 6/1990 Kawase
5,439,487 A 8/1995 Stanitzok
D368,330 S * 3/1996 Robinson ..... D29/119
5,649,336 A * 7/1997 Finch ..... A47K 10/42 15/104.94
6,145,128 A * 11/2000 Suzuki ..... A41D 13/087 2/21
6,898,819 B2 5/2005 Tanaka et al.
D553,315 S 10/2007 Lynde et al.
7,490,382 B2 * 2/2009 Benjamin ..... A61Q 19/005 15/104.94
9,259,075 B2 * 2/2016 Gordon ..... A47K 7/02
D770,092 S * 10/2016 Lim ..... D28/7
D774,266 S * 12/2016 Baldwin ..... D32/40
D775,773 S 1/2017 Baldwin et al.
D779,142 S 2/2017 Baldwin
D796,746 S 9/2017 Barlow
10,130,236 B2 11/2018 Klimis et al.
D849,998 S * 5/2019 Lim ..... D28/7
10,426,299 B2 * 10/2019 Snyder ..... A61H 7/003
11,241,075 B2 * 2/2022 Silva ..... B65D 43/163
11,383,479 B2 * 7/2022 Vatter ..... B32B 3/30
11,412,830 B2 * 8/2022 Silva ..... B32B 3/08
2001/0047534 A1 12/2001 Sandusky
(Continued)

OTHER PUBLICATIONS

Website, http://www.glov.co/shop/, retrieved Nov. 3, 2017, 5 pp.

*Primary Examiner* — Alissa L Hoey
(74) *Attorney, Agent, or Firm* — Cermak & McGowan LLP; Malcolm K. McGowan

(57) ABSTRACT

A washcloth or mitt is used for various cleansing needs and is constructed of a single, or of multiple pieces of material.

8 Claims, 16 Drawing Sheets

(56) References Cited

U.S. PATENT DOCUMENTS

| | | | | |
|---|---|---|---|---|
| 2002/0107528 | A1 | 8/2002 | Vayrette | |
| 2002/0155234 | A1 | 10/2002 | Seth | |
| 2002/0178482 | A1* | 12/2002 | Samuelsson | A47K 7/02 2/16 |
| 2003/0008588 | A1 | 1/2003 | Kohlruss et al. | |
| 2003/0059571 | A1 | 3/2003 | Harrison | |
| 2005/0229349 | A1* | 10/2005 | Foser | A01K 13/002 15/104.94 |
| 2007/0256261 | A1 | 11/2007 | Benitez, Jr. et al. | |
| 2011/0167582 | A1 | 7/2011 | Huang | |
| 2011/0239394 | A1 | 10/2011 | Pisacane et al. | |
| 2013/0198989 | A1 | 8/2013 | Jemsby et al. | |
| 2014/0075702 | A1 | 3/2014 | Lott | |
| 2014/0317866 | A1 | 10/2014 | Burt | |
| 2015/0000060 | A1 | 1/2015 | Collins et al. | |
| 2015/0128369 | A1* | 5/2015 | Zorzo | A47L 13/20 15/209.1 |
| 2015/0196171 | A1 | 7/2015 | Joseff et al. | |
| 2015/0216287 | A1* | 8/2015 | Matsushita | A47L 13/16 150/154 |
| 2015/0266064 | A1* | 9/2015 | Humiston | A45D 34/04 15/209.1 |
| 2015/0305989 | A1 | 10/2015 | Lupano | |
| 2016/0128521 | A1 | 5/2016 | McCarthy | |
| 2018/0168409 | A1 | 6/2018 | Farran et al. | |
| 2018/0360194 | A1* | 12/2018 | Cho | A45D 34/04 |
| 2018/0360288 | A1* | 12/2018 | Bradley | B32B 9/02 |
| 2019/0029397 | A1 | 1/2019 | Huebner | |
| 2019/0059548 | A1* | 2/2019 | Chaillet-Piquand | A45D 33/34 |
| 2020/0008628 | A1* | 1/2020 | Adams | A47K 7/02 |
| 2020/0170377 | A1* | 6/2020 | Tarajano | A45D 34/042 |
| 2021/0212545 | A1* | 7/2021 | Fritsch | A47L 13/16 |

* cited by examiner

MULTI-FUNCTION WASHCLOTH MITT

This application is a Continuation of, and claims priority under 35 U.S.C. § 120 to, U.S. patent application Ser. No. 15/664,066, filed 31 Jul. 2017, which claimed priority under 35 U.S.C. § 119 to U.S. Provisional App. No. 62/369,117, filed 31 Jul. 2016, the entireties of which is incorporated by reference herein.

BACKGROUND

Field of Endeavor

The present invention relates to devices, systems, and processes useful as washcloths, facial-cleansing textiles, body-washing textiles, and makeup removers, and more specifically, to mitts and washcloths useful for these purposes.

Brief Description of the Related Art

Existing commercial washcloths present a number of deficiencies that are familiar to consumers. For example, most commercially available washcloths:

a) Are too coarse for sensitive skin, especially for the skin of older individuals, infants or children, and anyone suffering from a skin condition such as rosacea, acne, eczema, dermatitis, etc.;
b) Are difficult to manage while washing the body or face, especially when bathing fidgety children;
c) Are difficult for children to use effectively on their own;
d) Are clumsy and unattractive to hang dry, and commonly have no loop or feature to allow them to be easily hung dry;
e) Contain loops for hanging dry that tear away from the body of the product easily, leaving the user with an unhelpful length of ribbon or fabric long before the rest of the item has outlived its usefulness;
f) Are so bulky that they impede targeted cleansing, or are impractical for cleansing of small areas such as outer ear folds;
g) Are made of materials that stain easily and are covered or impregnated with makeup marks after just a few uses;
h) Are made of materials that cannot withstand bleach or common facial acne remedies, such as benzoyl peroxide, and so the washcloths are either discolored by the chemicals (making the product less visually attractive and desirable, from the perspective of many users), or the textile is significantly weakened, resulting in a much shorter product "life;"
i) Are so thick that airflow is impeded during the drying process, making bacterial growths and unpleasant smells a common problem;
j) Tend to slip around the hands of the user instead of staying fixed in place on the user's hand, making it harder for the user to control the cloth. Generally, the washcloth is made of one piece of fabric, or it may be made of two or more pieces, sewn into layers. These layers may be the same type of fabric, or they may have similar coefficients of drag against skin. The result of these types of washcloth construction is that there is no distinction between the palmar side (which is held against the user's palm) and the side that is intended to cleanse the user's skin. Either they are identical, or the differences between the sides do not relate to the coefficient of drag across the skin (e.g., the differences are decorative, rather than providing the user with surface faces containing more or less drag against the skin). This lack of differentiation between the frictional drag inherent in the two sides of the cloth reduces the effectiveness of washcloths, since the user's attempts to move the cloth around the area to be cleansed may be ineffective—the washcloth is as likely to adhere to the user's hand as it is to the user's face (or whatever skin surface is intended to be cleansed).

Personal washing mitts have been devised to solve some of the problems presented by washcloths, but many problems remain. Washing mitts:

a) Are difficult to dry, as the multiple layers of fabric impede airflow, often resulting in bacterial growths and unpleasant smells;
b) Are designed such that they tend to fold in on themselves during drying, reducing the flow of air through the inside of the mitt and making bacterial growths and unpleasant smells a common problem;
c) Are difficult to pull onto the hand while wet, since many fabrics tend to cling to skin when wet. As a result, the portion of the mitt that is cinched or snug around the wrist to help keep it in place will become difficult to manipulate into the desired position once it is wet with dispersants such as water or cleansing solvents;
d) Are made of thick fabrics with insufficient stretch to enable them to fit on a variety of hand sizes, and are often too small, fitting the hands of only a segment of the population, or are so large that they are not much more manageable than washcloths;
e) Due to the problems mentioned above, and due to the types of fabrics used, may not provide more maneuverability to the user than traditional washcloths;
f) Are made of materials that stain easily and are covered or impregnated with makeup marks after just a few uses;
g) Are made of materials that cannot withstand bleach or common facial acne remedies, such as benzoyl peroxide, and so the mitts are either discolored by the chemicals (making the product less visually attractive and desirable, from the perspective of many users), or the textile is significantly weakened, resulting in a much shorter product "life;"
h) Do not contain a feature such as a loop of fabric that allows the product to hang to dry, or contain loops for hanging to dry that are unsatisfactory, due to manufacturing methods or federal safety regulations that pertain to the lengths of fabric loops that can be found on children's products; often, they contain loops for hanging dry that are too short to fit on many common hooks, bathtub hardware, or other useful places for hanging dry;
i) Contain loops for hanging dry that tear away from the body of the product easily, leaving the user with an unhelpful length of ribbon or fabric long before the rest of the item has outlived its usefulness;
j) Do not contain features to enhance the safety of the user, or prevent falls of the user in wet, slippery bathrooms;
k) Have no variations in fabric content or construction to customize the type of cleaning (i.e., more coarse fabric surface for exfoliation of skin cells, or non-irritating fabrics for sensitive skin) required by different areas of skin and different levels of skin sensitivity;
l) Do not contain features that can provide different shapes or thicknesses of fabric to more appropriately fit the type of area to be cleaned, especially for smaller areas (e.g., small outer ear folds or small creases of eyelids);

m) Tend to employ decorative details that increase the bulk of fabric on the mitt, further increasing drying times and increasing the likelihood of bacterial growths and unpleasant smells;

n) Do not contain features that distinguish one side from the other, so that users have no readily apparent method of determining which side may have already been used, and which is still clean and available for the next use, which may result in using a "soiled" material for cleansing, or more laundering than is necessary.

SUMMARY

According to a first aspect of the invention, a multi-function washclott mitt comprises a mitt having an exterior, an interior pouch, and an opening from the interior pouch to the exterior, wherein the mitt is formed of two layers of different first and second fabrics, wherein the first fabric has a first side with a first coefficient of friction and a second side with a second coefficient of friction, the first coefficient of friction being greater than the second coefficient of friction.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The inventions of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
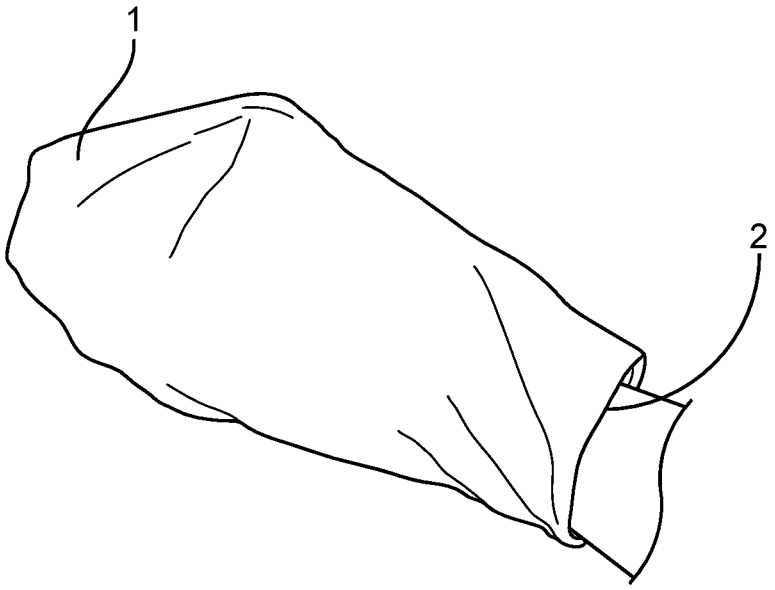
FIG. 1 shows a palmar (or ventral) view of a washing mitt embodying teachings of the present disclosure.

Clarifiction of Terminology Used in, and Practical Concerns Related to, this Disclosure The singular forms "a," "an," and "the" include plural referents unless the context clearly dictates otherwise. Thus, for example, reference to "a solvent" includes reference to one or more of such solvents, and reference to "the dispersant" includes reference to one or more of such dispersants. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a range of 1 to 5 should be interpreted to include not only the explicitly recited limits of 1 and 5, but also to include individual values such as 2, 2.7, 3.6, 4.2, and sub-ranges such as 1-2.5, 1.8-3.2, 2.6-4.9, etc. This interpretation should apply regardless of the breadth of the range or the characteristic being described, and also applies to open-ended ranges reciting only one end point, such as "greater than 25," or "less than 10."

In general terms, washcloths and washing mitts as described herein include a washcloth or washing mitt designed for use by infants, children, and adults. The construction, shape, fabric content, fabric layering, and lamination of other materials onto the fabric of the washcloth or mitt can address various problems of which adult users and parents of infants and children complain, as discussed above.

When discussing fabrics, the "right" side of a fabric is understood to be the surface of the fabric intended by the manufacturer to be used on the outside, or visible side, of a garment or sewn item. With napped or plush fabrics, the "right" side of the fabric is understood to be the side featuring the nap, rather than the opposite side, which usually has the appearance of a woven or knit fabric.

In this document, a "loop" should be understood to mean a length of fabric or cord that is usually longer than it is wide (although it is possible that it could be wider than it is long), and that is attached in some way to the product. This loop is usually sewn into the mitt for the purpose of hanging the mitt on a hook or other item (such as a water faucet spout) for drying. The loop may be attached to the mitt in a variety of ways, a common one being such that the extremities of the fabric length attach to the mitt at the same spot. Alternately, it may be attached so that the extreme ends of the fabric length are spread apart, either to their fullest width, or any distance between touching and fully extended, and attached to the product individually at these fabric end points. Another example of the loop's construction is that one end of the fabric length may be folded back and attached back onto the loop fabric at some point other than the opposite end, for example, the mid-point of the length of loop fabric. In this example, one end of the loop fabric attaches to the product, and one attaches to the fabric of the loop (back onto itself). This length of fabric is usually of a consistent width (e.g., 0.25 inches by 5 inches), but it does not have to be a geometrically regular length of fabric. For example, it may be a piece of ribbon with undulating or irregular curves, yet its length and texture still makes it useful for functioning as a length of fabric to be placed around a hook, thumb, etc.

In this document, the term "fabric" should be understood to refer to the materials used in the construction of the mitt. While in many embodiments this material is a woven or knit textile, it may also be another type of material, such as spun-bond, non-woven material, felt, fabrics coated with substances such as silicone, or non-fabric materials such as latex or rubber. While many iterations of the product described herein are reusable and washable, many of the features described in this application are also applicable to disposable and non-washable versions of the product. The use of terms such as "fabric" and "textile" are not meant to limit the materials of which the mitt may be constructed, sewn, formed, knit, or molded. Additionally, while many of the preferred embodiments would function optimally if made from a water-permeable, absorbent material, it is also possible that other embodiments would benefit from non-water-permeable materials, such as rubber- or silicone-coated substances, or materials such as molded latex. Thus, the characteristics described herein should not be understood as applying only to "traditional" bath textiles, such as terrycloth or waffle-knit textiles, but also to newer materials such as spun bond, or materials not traditionally used for personal washing, such as silicone-coated fabrics or molded latex.

In this application, it is assumed that shorter drying times are preferable to longer drying times for items used for personal care. Increased drying times can result in bacterial growths and unpleasant smells being present in the item, which users commonly find undesirable.

It is assumed that reusable, washable products are preferable to single-use, disposable products, primarily due to environmental concerns. Numerous studies have shown that the laundering of reusable products (including the water consumed, the detergents employed, and the resulting wastewater processing) has less of an environmental impact than disposal of comparable single-use products. This disclosure primarily relates to features employed in reusable, washable washing products, as one of the primary aims of the features discussed herein is a reduction in consumers' reliance on single-use, disposable products.

In conjunction with the included drawings and photos, this detailed description is intended to impart an understanding of the teachings herein and not to define their metes and bounds. A variety of embodiments, illustrating aspects of the present teaching, are presented in detail below. However, these examples are in no way intended to be exhaustive of the variation that may be applied to the present teachings.

While the original use of the item described in this application was cleansing or exfoliation of human skin, the same characteristics may be useful for cleansing human hair, or for the hair (or fur) and tissues of different animals, such as dogs, cats, horses, reptiles, etc. Additionally, the characteristics that make the item practical for cleansing human and animal tissues also provide benefits for other cleansing applications, such as polishing furniture or cars, or cleansing jewelry, porcelain figurines, or flat surfaces such as walls. While the examples of potential uses in this document refer primarily to human skin cleansing, the same practical benefits are relevant to other cleansing, dusting, and polishing applications.

Detailed Description of Exemplary Embodiments

FIG. 1 shows a palmar (or ventral) view of a washing mitt embodying teachings of the present disclosure.

Many embodiments of the item involve a washcloth that is a closed mitt, covering some or all of the fingers, possibly including the thumb, so that when the user's hand moves, the cloth moves, regardless of whether the interior of the mitt fabric itself is adhering to the fingers. Many embodiments cover the entire hand, including the fingers and (optionally) the thumb.

The mitt is made of material that encircles the hand, either because the layers of fabric are sewn together 1, or because the fabric is knitted in such a way that some of the sides are closed. In many embodiments, the lowest peripheral edge remains open 2, because this is where the hand enters the interior of the mitt.

Many embodiments of the mitt are constructed by sewing the materials together, but they may also be knit, molded, woven, glued, or connected by other means such that the material encircles some portion of the hand, or some portion of the fingers, or a portion of the hand and fingers combined, or the entire hand, all fingers, and portions of the forearm.

The mitt fabric may be patterned, knit, or sewn so that the end that fits over the distal fingertips is rounded or otherwise formed so that it roughly follows the contour of the distal tip of the various-sized fingers of a hand.

Figure 2:
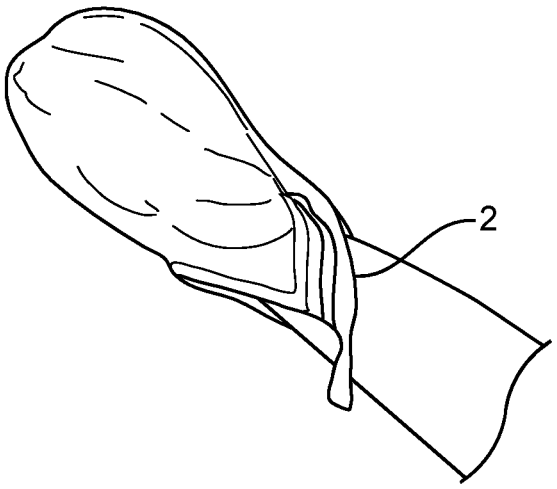
FIG. 2 shows a palmar (or ventral) view of a washing mitt embodying teachings of the present disclosure, which extends beyond the wrist, onto the arm.

FIG. 2 shows a palmar (or ventral) view of a washing mitt embodying teachings of the present disclosure. In this embodiment, the lowest peripheral end 2 extends beyond the wrist, onto the arm. This embodiment is particularly useful for users who wish to cleanse body parts other than the face, such as the upper and lower back. Due to the limitations of the human form, and to limitations caused by the relative flexibility and mobility of individual users, it may be more feasible and expedient for some individuals to rub ventral or dorsal surfaces of the forearm or wrist against another body part for cleansing. For example, while many individuals cannot move their arms and hands into a position to rub their palm against their upper back, they may be able to rub the dorsal surface of the hand, wrist, or forearm against the upper back. If a mitt were only long enough to extend to the wrist joint, the motion required to rub the dorsal surface of the hand, wrist, or forearm against the back might dislodge the mitt from the hand, or the mitt might not be long enough to cover the part of the user's arm that is being employed for washing/rubbing motions (e.g., the end of the forearm closer to the wrist). A mitt that extends beyond the wrist, onto the forearm by one or more inches would be more likely to remain in place during the user's washing motions, and could be long enough to be moved by the wrist or forearm across the skin surface the user intends to clean.

Figure 3:
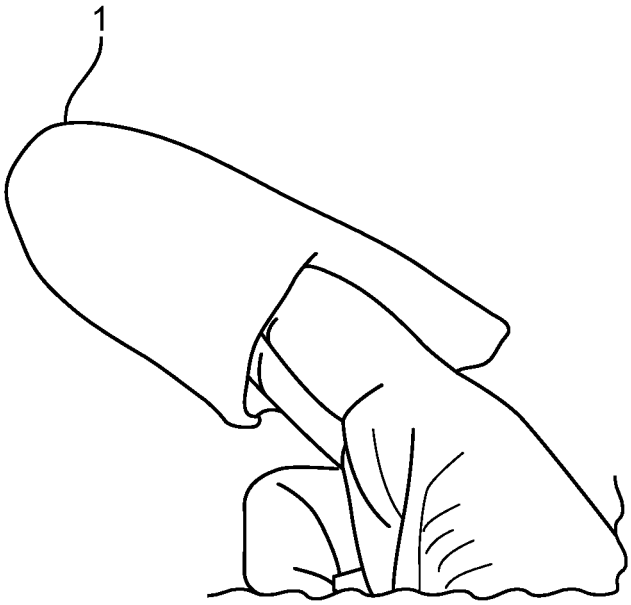
FIG. 3 shows a lateral, radial view of a washing mitt embodying teachings of the present disclosure.

FIG. 3 shows a lateral, radial view of a washing mitt embodying teachings of the present disclosure. Namely, this shows a smaller iteration of the mitt that covers the distal ends of the fingers 1, but that does not extend to cover the entire hand of the user.

Smaller embodiments of the mitt cover fingers only, while slightly larger embodiments cover the fingers and portions of the palm. The smallest embodiment fits around one or more fingers, or just the distal ends of the fingers 1, ending somewhere between the distal interphalangeal joint and the proximal point where the finger joins the palm 3.

Numerous benefits can be realized from this smaller embodiment of the mitt. Manufacturing and distribution costs can be reduced, the user's storage space for washing textiles can be reduced, and the user's laundering efficiency can be improved. More importantly, smaller embodiments of the mitt are highly useful for specialized cleansing functions, such as cleansing of small or delicate areas of skin, such as the eyes, ears, or nostrils. Smaller mitts can be more easily maneuvered around specific areas of the body, and have proven particularly useful for cleansing the eye and ear areas of adults, children, infants, and animals such as dogs and cats. The reduction in the bulk of fabric, and the ability to wrap the fabric closely around a finger or fingers greatly increases the usefulness of the mitt for cleansing applications requiring specificity, precision, or special care or gentler pressure.

Figure 4:
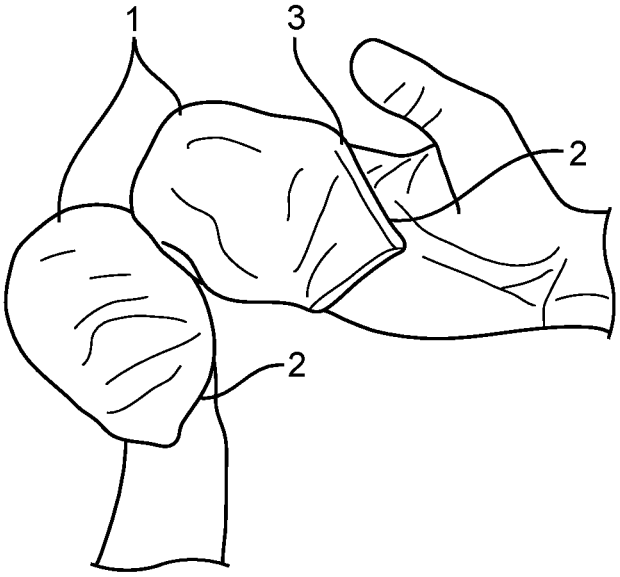
FIG. 4 shows a palmar (or ventral) view of a washing mitt embodying teachings of the present disclosure.

FIG. 4 shows a palmar (or ventral) view of a washing mitt embodying teachings of the present disclosure.

This embodiment encloses three or four distal fingertips 1, and is open at the lowest peripheral point (near the proximal end of the fingers) 2. This version of the mitt may reach as far as the proximal point of the fingers, where they meet the palm 3, or extend slightly further, onto the palmar and dorsal side of the hand. It should be noted that this same size also fits over the entire hand (including the thumb) of most toddlers and children (as shown in the illustration), giving them a greater degree of personal washing control.

Also referring to FIG. 4, at the lowest peripheral end, the fabric is long enough that an adult's thumb can reach in toward the palm (or ventral) side of any of the four fingers. The thumb can then touch the radial, lateral edge of the hand or index finger, or the ventral surface of the palm or fingers, or even the dorsal side of the hand or index finger (if possible), pressing against the mitt fabric (most likely near the lowest peripheral end 2), and hold the mitt in place during use by pressing the fabric between the thumb and chosen hand/finger area during use.

Still referring the FIG. 4, the user can alternately hold the mitt in place by extending the fingers away from each other, laterally, in order to stretch the mitt taut, thus holding it in place by the greater frictional drag created by the pressure of the interior lateral edges of the fabric against the lateral finger surfaces. The ability to hold the mitt in place either by lateral finger extension, or by squeezing the fabric between the thumb and the lateral, ventral, or even dorsal side of the mitt surface relieves the mitt of the need to further extend onto the hand, for example, as far as the wrist, in order to stay in place during use. This reduced size provides numerous benefits, which may include reducing production costs such as materials and manufacturing, decreasing the drying time required after use (thus making it less likely that bacterial growths will occur and unpleasant smells be created), and greater maneuverability on the part of the user, since the user can more quickly and easily remove the mitt and turn it around, in order to switch the ventral and dorsal sides, to reach a clean, unused surface. Additionally, this reduced size makes the mitt particularly useful for children (exemplified by the child's hand on the left in the illustration), for adults with smaller hands (for whom "normal"-sized washing mitts are too large and unmanageable), and for anyone wanting a reduced bulk of fabric in order to achieve a higher degree of washing control and precision during cleansing.

Figure 5:
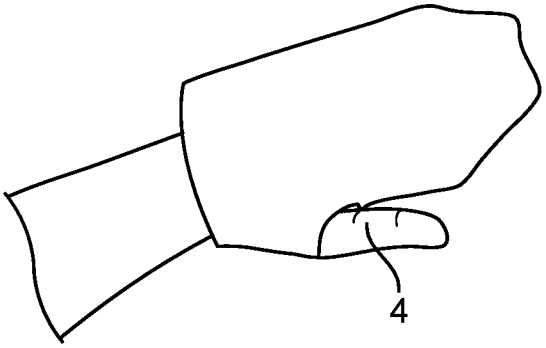
FIG. 5 shows a palmar view of the mitt, embodying various teachings of the present disclosure.

FIG. 5 shows a palmar view of the mitt, embodying various teachings of the present disclosure. Some versions of the mitt have a slit 4 that enables the thumb to protrude from the interior of the mitt to its exterior. In this version, the dorsal and ventral sides of the mitt are reattached on the lateral, radial side, closer to the lower peripheral end, near the proximal end of the thumb, anywhere from the metacarpohalangeal thumb joint to the (radial side of the) wrist joint. The thumb opening provides a number of potential benefits to the user, including helping the mitt fit on a variety of hand sizes. For example, users with large hands may elect to place the thumb through the opening, freeing up the inside ulnar-to-radial surface area for the other four fingers and palm. Users with smaller hands may elect to retain the thumb inside the mitt, in order to "fill out" the mitt from the radial to ulnar sides, and obtain a better fit. The protrusion of the thumb can help the user retain a degree of mobility and hand function, especially for parents using the mitt while bathing infants or children—the thumb can be available to help the parent retain a grip on the child, while the mitt can still function for washing.

Figure 6:
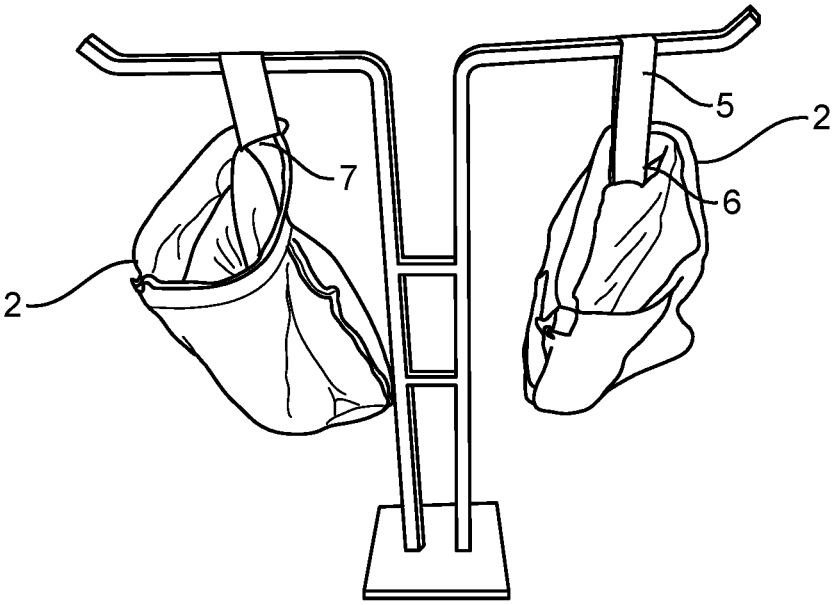
FIG. 6 shows a hanging, primarily proximal (lower peripheral) view of the mitt embodying various teachings of the present disclosure, namely, the placement of loops for hanging the mitt to dry.

FIG. 6 shows a hanging, primarily proximal (lower peripheral) view of the mitt embodying various teachings of the present disclosure, namely, the placement of loops (or "ribbons") 5 for hanging the mitt to dry. The placement of the loop for hanging the mitt dry may change on the mitt. In some embodiments, it is attached on the interior of the main body of the mitt. For example, it could be a doubled-over length of fabric, sewn into the seam approximately two to three inches above the lower peripheral end (where the hand enters) 2, on the interior of the mitt 6, on either the dorsal or ventral face, or on the lateral edge, placed at a 90-45 degree angle to the seam into which it is sewn, thus encouraging the mitt to open slightly while hanging dry. It could also be placed in other locations, such as approximately one inch inside the lower peripheral end 7. Placing the ribbon inside the mitt for drying encourages the ventral and dorsal sides of the mitt to separate from each other, increasing the airflow through the mitt and thus decreasing drying times after use. Additionally, many users find loops placed on the exterior of the mitt to be irritating, since they may touch the skin that the user is attempting the clean. The ribbon may also be placed on the exterior of the mitt 8, in various locations.

Figure 7:
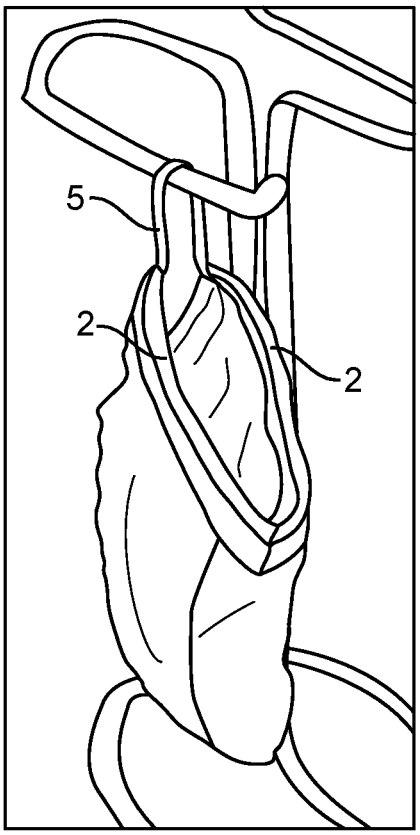
FIG. 7 shows a hanging view of the mitt embodying teachings of the present disclosure.

FIG. 7 shows a hanging view of the mitt embodying teachings of the present disclosure. The length of fabric or ribbon 5 for hanging the product to dry may connect points on the ventral and dorsal sides of the fabric on the lowest peripheral end 2, rather than being reattached at the same point (on either the ventral or dorsal side). This method of attachment encourages faster drying and the avoidance of bacterial growths by making it more likely the ventral and dorsal sides of fabric will separate (thus increasing airflow through the mitt) when the mitt is hung dry on a hook or other object. Additionally, this method of ribbon placement avoids many of the problems inherent in the most common methods of loop placement, where the ends of the loop fabric are sewn into the mitt at the same point. As mentioned previously in this document, the common method of ribbon placement does not withstand repeated washing or use, and one or both of the ends of the fabric have a tendency to come loose, eliminating the shape of the loop, and rendering the feature useless for hanging the mitt to dry. By attaching the ribbon at two points, rather than one, the ribbon is more strongly attached to the mitt, and is less likely to detach with repeated use and washings.

Figure 8:
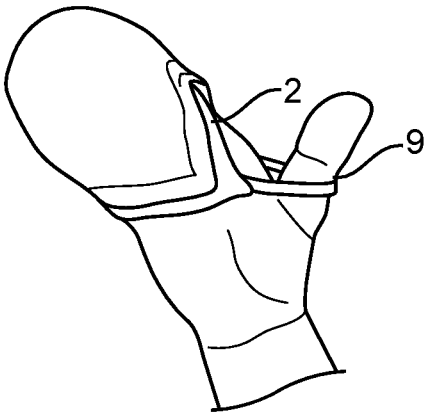
FIG. 8 shows a palmar view of the mitt embodying teachings of the present disclosure.

FIG. 8 shows a palmar view of the mitt embodying teachings of the present disclosure. In this embodiment of the mitt, a fabric loop or "hook" is optionally provided on the exterior of the mitt, usually near the lower peripheral end 2, advantageously adjacent to the opening through which the user's hand extends, or adjacent to the (optional) thumb opening slit. This loop may be of various lengths, extending from approximately one-half inch long to several inches long, and can be placed around the wearer's thumb 9, resting anywhere from the proximal joint where the thumb meets the palm, to the distal tip of the thumb, in order to assist the user in keeping the mitt in place, and preventing it from sliding off the distal tip of the fingers during use. Also, the loop allows the mitt to be hung for drying. This placement of the loop allows the mitt to fit on a variety of hand sizes, or allows the user to customize the degree to which the mitt is held taut against the hand by the simple means of extending the thumb laterally, away from the palm. This is a more simple and elegant method of cinching the mitt than many other potential methods, making it easier for the user to employ and easier and more cost-effective for the producer to manufacture.

The mitt may be made of dark-colored materials 10, so that makeup and other stains will not be noticeable. One of the most common complaints made by washcloth users is that makeup stains are often noticeable (even after thorough laundering) and considered unattractive to the extent that their presence can render the cloth unfit for use in the user's eyes. The presence of stains makes the cloth appear unsanitary, even if the cloth has been thoroughly laundered and safe for use. By rendering the makeup stains less noticeable, users are more likely to employ the mitt for more sessions, and are less likely to resort to single-use, disposable products in their search for more sanitary options.

Figure 9:
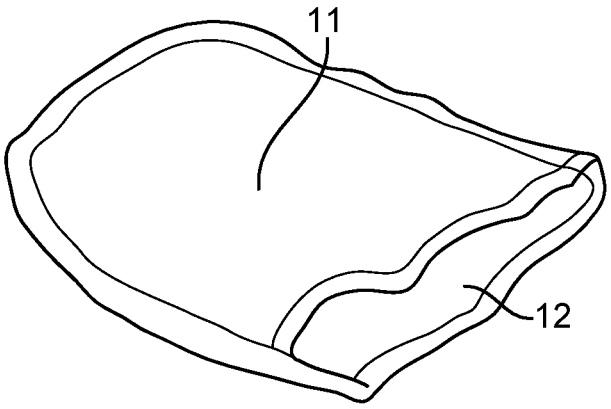
FIG. 9 shows a mitt embodying teachings of the present disclosure.

FIG. 9 shows a mitt embodying teachings of the present disclosure. The mitt may be patterned so that either the side fitting over the ventral area of the hand 11 or the dorsal area of the hand 12 is longer than the other, or shaped differently than the other, so that the user can keep track of which side has already been used, so as to increase the number of uses between laundering.

The mitt may be made of two separate fabrics, which may provide a variety of benefits, one of which is aesthetic appeal. For example, the dorsal side 12 may be made of a printed material, and the ventral side 11 of a solid material, or the opposite sides may be distinguishable from one another by a variety of other means, including but not limited to embroidery, marking, fabric texture, fabric color, etc. These fabrics may confer different benefits to the user, including that they may help the user distinguish which side has been previously used for cleansing, assisting the user in ensuring that the "clean" surface is the one to be used. Additionally, the distinctions between the sizes may indicate important functional elements of the mitt to the user. For example, the style of print on one side may indicate the type of cleansing for which the mitt or fabric side is most suited (e.g., a print including images of feathers, or other objects commonly understood to be soft, would indicate that the printed material is suitable for skin or areas of the body requiring soft, gentle textiles). Additionally, by varying the types of fabric contained in the mitt, the shortcomings of one of the textiles may be overcome. For example, the ventral side 11 may be made from a thick, coarse material for the purpose of exfoliating dead skin cells (note that the example involves the ventral and dorsal sides of the fabric, however, these sides may be reversed in other embodiments). A fabric that is suitable for exfoliation may not possess other characteristics that are desirable for a mitt intended for wet-application washing. For example, the thickness of the material may impede airflow through the mitt, which may slow drying times and result in bacterial growths and unpleasant smells. Or, such an exfoliating textile may not provide enough stretch or "give" to allow it to fit on hands of varying sizes. In this example, the alternate, dorsal side 12 may be made from a material that is significantly thinner or less tightly woven, permitting airflow into the mitt after use, and decreasing drying times. Also, a material with the quality of "give" or stretch could be incorporated into the dorsal side 12, providing the stretch necessary to enable the mitt to fit around large or small hands.

Figure 10:
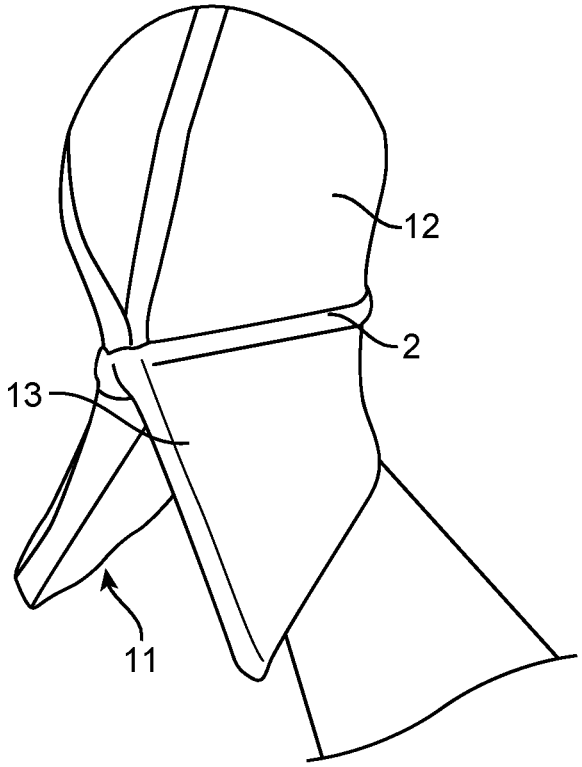
FIG. 10 shows a mitt embodying teachings of the present disclosure.

FIG. 10 shows a mitt embodying teachings of the present disclosure. The mitt may have a cuff 13 sewn into it, meaning a section of fabric that is attached to the lower peripheral end 2 of either the ventral and dorsal 12 faces, or of both, covering the proximal part of the hand that connects to the wrist, or extending onto the wrist itself. Similar to the example above, either the ventral 11 or dorsal 12 side of the cuff may be distinctive from the other (e.g., a different color, or they may be larger, more decorative, containing embroidered words, etc.). One potential benefit of this cuff design includes helping the user to keep track of which side has already been used, so as to increase the number of uses between laundering. Additionally, the cuff material itself may have desirable cleansing applications, and the sides may be made of materials with different cleansing properties, further increasing the usefulness of the mitt to the user while reducing the number of individual cleansing tools that must be purchased.

The mitt may be large enough to fit around the lateral sides of both of the user's hands, rather than only one. The pouch for hands may be large enough that the user can extend the material across the width of the face, and can move each section of the pouch around the face with some degree of independence for each hand, pushing against the right or left lateral edge (commonly made by the seam) of the mitt to move the entire mitt around the face. This type of mitt construction offers multiple benefits to the user—it provides a larger amount of material to be available to the user (roughly the same amount of usable area as a traditional washcloth), while providing the manageability and control of a mitt, since the seams of the dorsal and ventral faces allow the user to specifically control the movement of the mitt around the face, in a manner that is difficult with a non-enclosed, single-piece washcloth. While the mitt provides a similar level of usefulness as could be obtained by using two single-hand mitts at one time, it would cost less to manufacture than two separate, single-handed mitts, and so the end cost to the user could be reduced.

Figure 11:
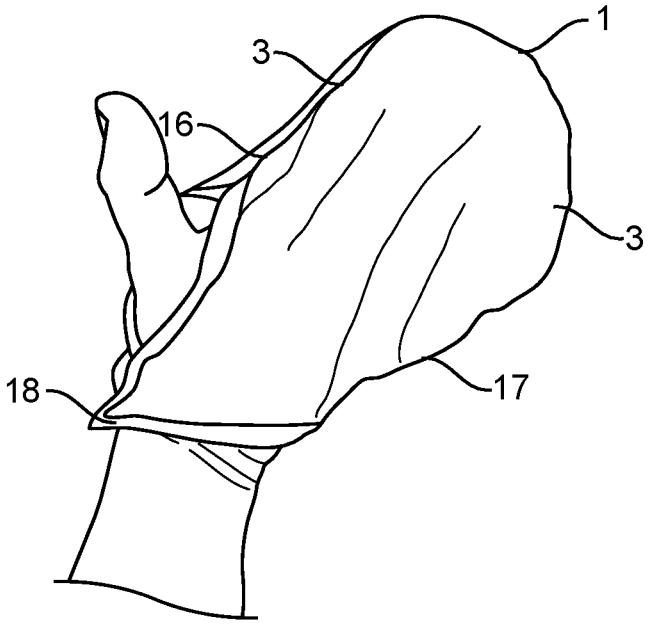
FIG. 11 shows a palmar view of a mitt embodying teachings of the present disclosure.

FIG. 11 shows a palmar view of a mitt embodying teachings of the present disclosure. In this embodiment, the mitt is shaped like a large droplet of water, wherein the larger, rounded side fits over the distal fingertips 1, the widest rounded section of the droplet corresponds roughly to the proximal phalanges 3, and the sloping lines that intersect to form a point begin at the radial 16 and ulnar 17 lateral edges of the palm. In this embodiment, the rounded edges stretching over the distal fingertips 1 are closed, with the dorsal and ventral sides of the fabric connected by means of a seam, or because that is how they are knit, molded, or otherwise formed. Additionally, some portion of the dorsal and ventral faces along the lateral sides of the curve, which extend around the lateral, outside edges of the index and small fingers, are also enclosed. The enclosed area either reaches partially along the lateral edge of the index and small fingers (leaving some area of the proximal ends of the fingers open), or the fabric is enclosed to the proximal points of the fingers, or it is enclosed beyond the proximal points of the fingers (enclosed as far as the lateral edges of the palm). In this embodiment, the portion of the mitt closer to the pointed end 18 of the droplet shape is considered the lower periphery. Enough of the triangular end must be open for the hand to be inserted, excepting the thumb, which extends outside of the droplet's outline. The dorsal and ventral sides of the fabric are connected or sewn, from the lowest peripheral end 18 (the point of the droplet) at the tip or on the radial side 16. This connection may extend from the lowest proximal point 18 toward the rounded, distal end of the mitt 1—it can be a single point of connection, or it can extend several inches along the radial edge of the palm 16, depending on the actual dimensions of the mitt and the construction details of the mitt in question. This connection or seam has the effect of cinching the mitt around the radial, proximal edge of the hand. By extending the ulnar finger edge or the thumb, or both, the user pulls the mitt taut, decreasing the likelihood that it will slide off or around the hand during use. This particular style of construction is a cost-effective, attractive, and elegant means of solving a fit/sizing problem inherent to many commercially available mitts. Additionally, the hand extension motion required to improve the mitt's fit on the hand has no detrimental impact on the usefulness of the mitt during washing activities—the user's fingers may either be extended outward, or contracted inward, towards themselves for the mitt to be useful during washing.

Figure 12:
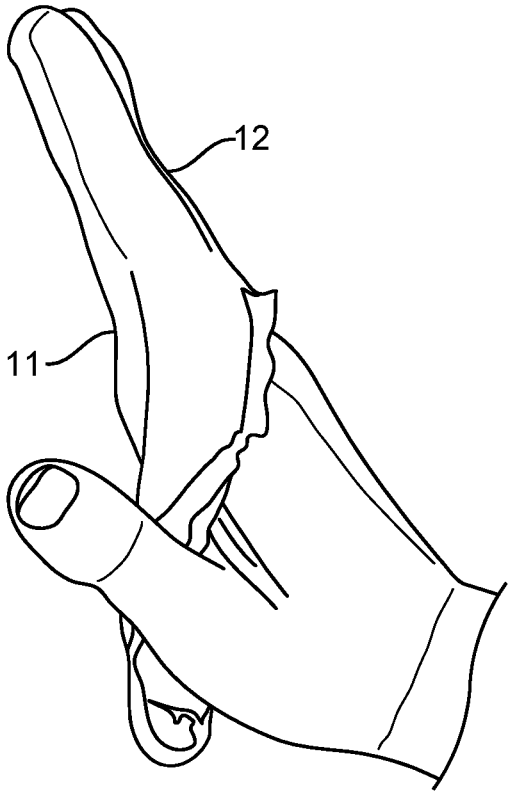
FIG. 12 shows a lateral, radial view of a mitt embodying teachings of the present disclosure.

FIG. 12 shows a lateral, radial view of a mitt embodying teachings of the present disclosure. This embodiment involves a mitt that is shorter on the dorsal side 12 (which is less likely to be employed as the washing surface) than the ventral side 11, so that airflow is greatly increased and drying time reduced after use. The difference in length may be approximately one inch up to five or more inches, depending on the distal-to-proximal (longitudinal) measurement of the mitt in question. An additional benefit of this particular embodiment is a reduction in manufacturing complexity and cost, and a reduction in the bulk of fabric needed, which reduces shipping costs and storage requirements for the manufacturer and user.

Figure 13:
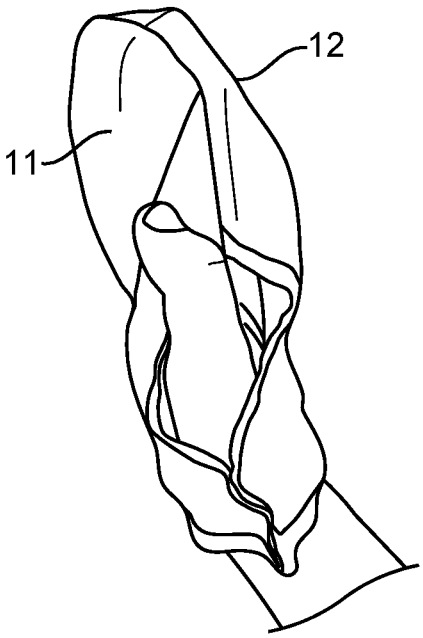
FIG. 13 shows a lateral, radial view of a mitt embodying teachings of the present disclosure.

FIG. 13 shows a lateral, radial view of a mitt embodying teachings of the present disclosure. This embodiment involves a mitt made of two different textiles, which could be of similar or different sizes, sewn together such that one covers the dorsal side of the hand 12, and the other covers the ventral side of the hand 11. For example, the dorsal side may be made of softer, finer fibers, such as plush polyester, suitable for sensitive skin (skin around the eyes, or skin which is inflamed with a condition such as rosacea). The ventral side might be made of a more coarse material, such as linen, that produces more friction when rubbed against the skin and which therefore serves the purpose of exfoliating dead skin cells. The user may choose to employ the alternate cleansing fabric by rotating the hand's position relevant to the face or body part to be cleansed (ventral side to dorsal side), or by turning the mitt around, so the ventral fabric becomes the dorsal fabric, or by alternating which hand wears the mitt. This embodiment gives the user a greater range of benefits than mitts in which both sides are made from one material, and reduces the number of cleansing tools the user must own, or the number that must be employed in a single washing session. In this example, the type of fabric incorporated into the mitt and the surface of the mitt on which it is employed (dorsal, ventral, or even lateral) may have many variations.

Figure 14:
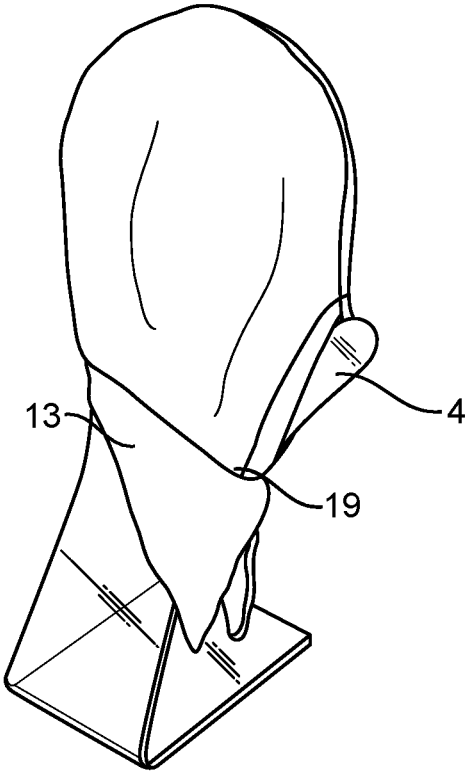
FIG. 14 shows a palmar view of a mitt embodying teachings of the present disclosure, mounted on a transparent stand.

FIG. 14 shows a palmar view of a mitt embodying teachings of the present disclosure, hung or mounted on a transparent stand. This version of the mitt has a cuff 13 that is knit, attached, or sewn onto it that has a smaller circumference than the circumference of the widest part of the mitt (the widest part of the mitt being the line which may be drawn between the furthermost ulnar and radial lateral edges of the hand). The cuff material would usually be a stretch knit textile, but it may also be another stretchy, non-woven material such as neoprene, so as to allow it to fit over a variety of wrist sizes, while keeping the mitt from slipping over the wider part of the hand during use. This fabric may or may not be the same material used in the main body of the mitt. The seam of the cuff where it is attached to the mitt 19 provides stiffness to the line where the mitt fabric meets the cuff. This stiffness serves the purpose of holding the mitt slightly open when it is hung to dry (by use of the attached loop, or through the thumb slit 4, or by another means), which greatly increases airflow through the product and decreases drying time.

Figure 15:
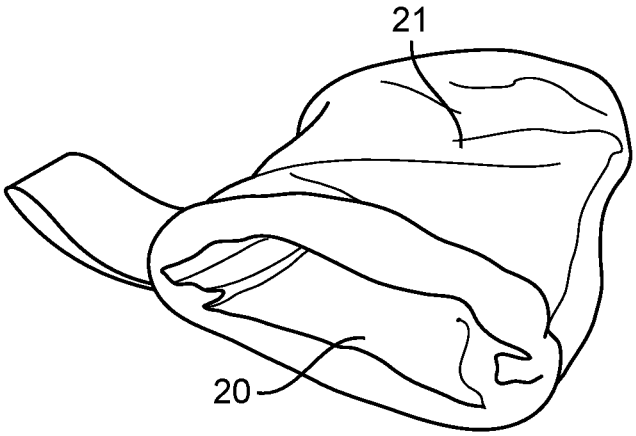
FIG. 15 shows a lower peripheral view of a mitt embodying teachings of the present disclosure.

FIG. 15 shows a lower peripheral view of a mitt embodying teachings of the present disclosure. The layering of plush or napped fabrics reduces a problem of frictional drag and improves the hand feel of the mitt in wet applications. Many of the softest commercially available fabrics have a significantly different feel on one side than the other. Especially with the synthetic versions of plush fabrics, including minky, velvet, velour, or other napped fabrics, the "right" side has more frictional "drag" than the knitted or woven "wrong" side when it is moved against skin. The softness of many synthetic or plush fabrics would make them useful as bath textiles for people with sensitive skin, including infants. However, the issue of drag (i.e., a higher coefficient of friction) makes them impractical; the plush or napped side tends to adhere to the part of skin that needs cleansing (e.g., the face), and the hand or fingers, which are held against the back ("wrong") side of the fabric, slip (because of a coefficient of friction that is too low). Especially when wet, the drag of the napped side and the slipperiness of the "wrong" side can increase. Additionally, while the napped side of these fabrics feels pleasant when wet, the "wrong" side feels unpleasantly clammy to the touch, more like wet clothing than the typical terrycloth consumers are accustomed to. To overcome the aforementioned problems, an embodiment of the washcloth may layer a thin, highly porous fabric on the interior of the mitt 20 against the "wrong," slippery side of the napped fabric, which forms the exterior of the mitt 21. Both sides of the inside of the mitt (dorsal and ventral) may be lined on the interior with the thin, porous fabric 20.

Figure 16:
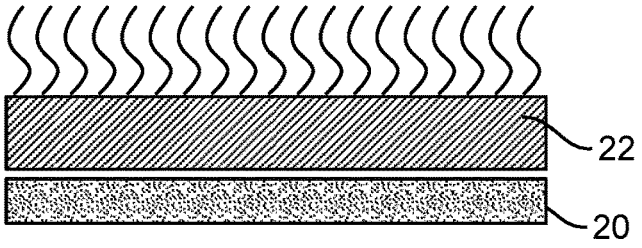
FIG. 16 shows a cross-section view of the fabrics which may be layered against one another.

FIG. 16 Shows a cross-section view of the fabrics which may be layered against one another. The fabric that is layered onto the interior surface of the mitt 20 may be thin terrycloth, French terrycloth, muslin, thin flannel, or one of many different types of knit or woven fabric. While still much softer than terrycloth found in most commercially available washcloths, these fabrics have more frictional drag than the "wrong," slippery side of the napped fabric 22. As such, they tend to adhere to the user's hand, and thus move as desired when a user slides them over the skin with the hand or fingertips.

Also, these fabrics may behave as if "glued" to the "wrong" side of the napped fabric when wet, that is, when wet and pressed against each other, the two fabrics have a high enough coefficient of friction to permit the user to use the mitt as a washcloth without the user's hand slipping within the mitt. Instead of the napped fabric sticking to the skin (e.g., face) when used alone, the layered fabric simultaneously grips the "wrong" side of the napped fabric, and has enough frictional drag to stay with the fingers as they move across the face or body.

The thin fabric layered inside the napped, plush fabric gives the inside of the mitt the pleasant, slightly rougher feel that washcloth users are accustomed to from bath textiles. As mentioned, many plush fabrics feel clammy and slick when wet, reminding the user more of wet clothing than a bath textile.

An additional embodiment of the washing mitt is similar to the embodiments discussed above in that it involves the use of fabrics that work well against the skin to be cleansed, but which feel unpleasant when wet on the interior surface that touches the user's hand. The "clamminess" or "slickness" of the interior of the wet fabric that touches the user's hand can be mitigated by a several processes that alter the feel of the "wrong" or interior side of the fabric. A manual method of changing the texture of the hand-facing fabric involves mechanically making numerous small scrapes or pulls in the slick side of the fabric, creating a rougher surface without actually diminishing the structural integrity of the knit or weave. This process is similar to the process used in felting wool. Alternately, the surface of synthetic fabrics may be altered through application of a mild chemical that would change the feel of the fabric without significantly damaging the integrity of the weave or knit of the fabric. Alternately, a substance such as silicone, rubber, or some other "tacky" material can be applied to the interior, hand-facing side of the fabric (see FIG. 15, item 20) in small dots, strips, or some other pattern, so that the fabric feels rougher and seems to "grip" the hand. All of these methods improve the "hand feel" of the interior, hand-facing surface of the mitt while maintaining the breathability of the original fabric. Additionally, these methods of providing greater "grip" to the interior of the mitt reduce the bulk of material required to construct the mitt, which may reduce manufacturing costs, and which reduces shipping and storage costs, as well as space.

Figure 17:
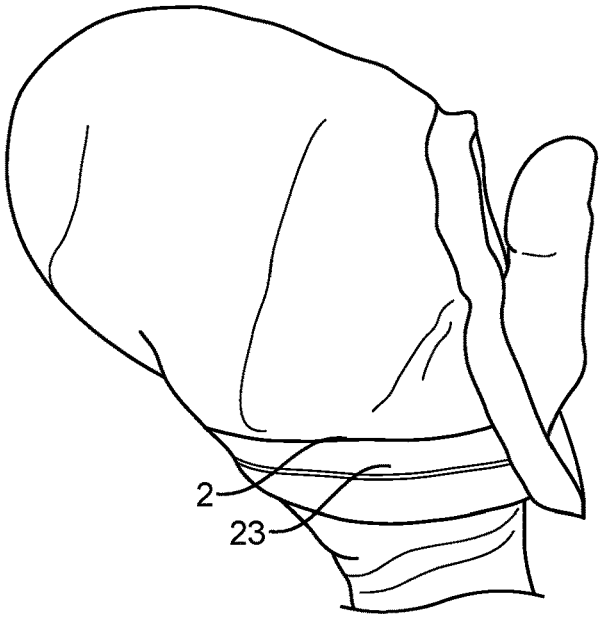
FIG. 17 shows a palmar view of a mitt embodying teachings of the present disclosure.

FIG. 17 shows a palmar view of a mitt embodying teachings of the present disclosure. This embodiment of the mitt incorporates safety features that aid the user in avoiding slipping or falling on wet or slippery surfaces, such as those frequently found in bathrooms. It is common for children and adults to press the hands (especially the proximal and palmar surface of the hand) against the surfaces of slippery objects, such as tubs or sinks, or against the floor, in order to steady themselves or to hold themselves upright, especially while reaching for something with another hand or part of the body. Therefore, it would be desirable for any mitt covering the proximal and/or palmar part of the hand to give the wearer additional "purchase" on such slippery surfaces, reducing the likelihood of falls and injuries. The lower peripheral portion of the mitt 2, that covers the proximal area of the hand, may be made of a material 23 with a surface that is less likely to move freely against wet porcelain, metal, or glass. Examples of such fabrics include neoprene-type materials, or rubber-coated woven, knit, or spun-bond fabrics, or any other materials that tend to "grab" rather than slide against smooth surfaces (especially non-porous bathroom fixtures such as tubs and sinks). The photo depicts a polyester ribbon laminated with a silicone strip sewn on top of the lower proximal end of the mitt, but other means of accomplishing this aim include laminating silicone or onto the portion of the mitt that would benefit from additional "grab," in the form of a coating, or a partial coating of strips, small dots, or other shapes. A partial coating would serve the purpose of giving the fabric "grab" against the slippery surfaces, while minimally affecting breathability of the overall mitt fabric, which aids in reducing drying times. Comparable, commercially existing washing tools do not address the user's safety during washing activities. If one considers the high incidence of falls and accidents in bathrooms due to the combination of slick surfaces, the presence of water, and the types of activities that are accomplished in bathrooms, such features would be considered highly beneficial improvements to washing mitts.

Figure 18:
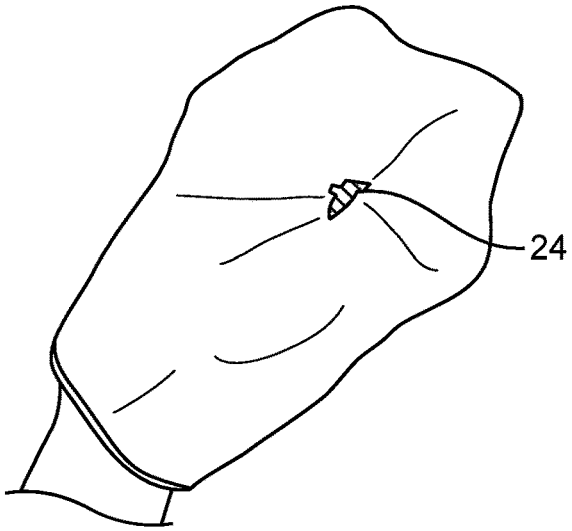
FIG. 18 shows a palmar view of a mitt embodying teachings of the present disclosure.

FIG. 18 shows a palmar view of a mitt embodying teachings of the present disclosure. A further embodiment that would serve the purpose of keeping the mitt in place on a hand during use would have a point, roughly near the lateral and distal/proximal midpoint, that connects the dorsal and ventral sides of the mitt fabric. This is accomplished with stitching 24 in the mitt depicted in the illustration, but the same effect could be achieved with a hook, snap, or Velcro closure on the interior dorsal and ventral surfaces of the mitt fabric. This point could be placed so that it fits between the middle and fourth fingers of most adults' hands. Such an attachment would not limit the mitt's sizing flexibility as much as a glove's finger sections, yet it would provide more fixed points for fingers to work against when moving than a traditional mitt. This attachment point would serve to make the mitt more manageable for a variety of hand sizes, while simultaneously requiring less fabric yardage and a lower level of manufacturing complexity than gloves made for the same purpose.

Figure 19:
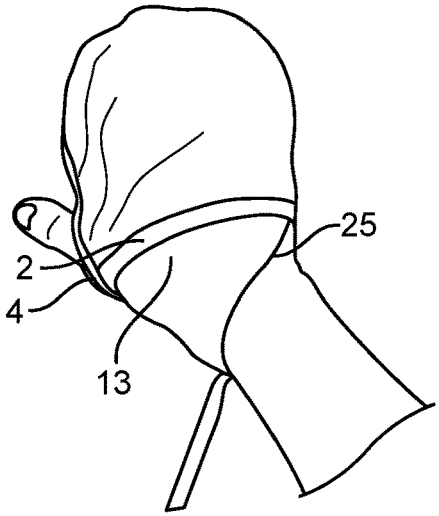
FIG. 19 shows a dorsal view of a mitt embodying teachings of the present disclosure.

FIG. 19 shows a dorsal view of a mitt embodying teachings of the present disclosure. A further embodiment of the mitt involves a cuff 13, the portion of which encircles the proximal end of the mitt 2, made of stretchy material that holds the mitt more firmly in place and that can accommodate a variety of hand sizes. One preferred embodiment of a cuff 25 is asymmetrical, in that one side of the cuff (ulnar or radial) is shorter than the other side. The short end may appear to disappear into the mitt at its lateral edge, while the other longer side may be approximately four inches long from the distal end of the cuff to the proximal end, but it may be longer or shorter than four inches. The longer side of the cuff would most likely be near the radial side of the mitt, designed for the thumb (usually involving a slit for the thumb to protrude 4), but it could correspond to the ulnar side of the hand. This longer edge of the cuff is useful in that it pulls the mitt taut against the user's hand when the user widens the proximal base of the hand by extending the thumb laterally, away from the rest of the hand. This style of cuff provides the user with the ability to hold the mitt taut against the lateral edges of the hand without the drawbacks of a symmetrical, relatively wider cuff. A more uniformly wide, symmetrical cuff makes it difficult to pull the mitt on the hand, especially when the mitt or hand is wet, as the wetness causes the fabric to adhere to the hand. A symmetrically wide cuff would generally contain more fabric, and wet fabric tends to adhere to skin. It follows that the less cuff fabric that is present, the less the cuff will impede the placement of the mitt on the hand when the mitt or hand is wet.

The cuff may be made of a material that is more permeable than the material used in the washing area of the mitt, increasing airflow through the mitt when drying. Finally, the unevenness of the cuff reduces the amount of material needed for the mitt and reduces manufacturing costs, as well as the amount of fabric which must eventually dry before bacterial growths and unpleasant smells emerge.

Figure 20:
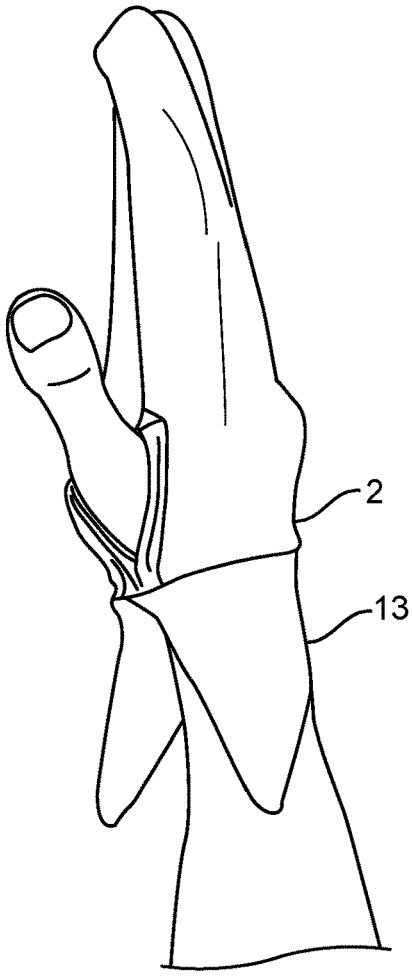
FIG. 20 shows a proximal, radial view of a mitt embodying teachings of the present disclosure.

FIG. 20 shows a proximal, radial view of a mitt embodying teachings of the present disclosure. A further embodiment of the mitt also involves separate pieces of fabric for the mitt body area (primary washing surface) and the proximal, wrist cuff area 13. However, in this version, the dorsal and ventral faces of the cuff are not sewn together, nor are they made into a continuous loop of fabric. In this embodiment, they are made of two separate flaps that reach down from the lower proximal end of the mitt 2. Either of these flaps may be attached to either the dorsal or ventral face of the mitt, however, they may be situated differently, such as positioned so that the midpoint of each cuff flap is placed near a radial or ulnar lateral edge of the hand. These flaps may be semi-rounds, rectangles, squares, triangles, or other shapes. The two flaps may not be identical in shape to each other. The flaps serve multiple purposes: they give the user something to grab with the thumb and forefinger to pull the mitt over the hand; the seam attaching the cuff flaps to the body of the mitt serves the purpose of helping to hold the mitt open during drying, thus increasing airflow and reducing drying times; the weight of the flaps tends to help pull the mitt open when drying, further increasing airflow through the mitt, thus reducing drying times; by being two separate flaps, rather than one continuous loop, the cuff is much easier to pull over the hand when wet than continuous loops, which tend to stick to skin when wet; and the bulk and weight of the cuff serves as a cantilever to the fabric of the body of the mitt, giving the mitt a more substantial, high-quality feel without impeding airflow (thus increasing drying times) and without making the mitt more cumbersome to use to place on the hand when wet. While this mitt construction does not impede the placement of the mitt on the hand when wet, it does marginally increase the friction of the mitt against the hand during use, thus helping the mitt stay on the hand during washing activities. The cuff material may be made of a more permeable fabric than the washing surface of the mitt, increasing airflow through the mitt when it is drying.

Figure 21:
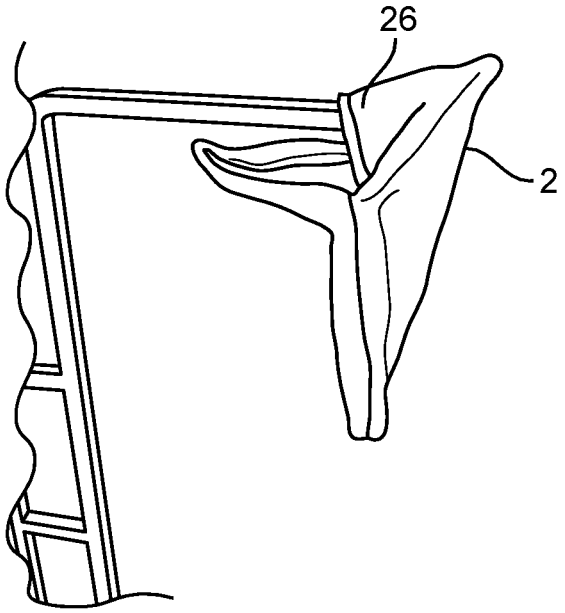
FIG. 21 shows a lateral, hanging view of a mitt embodying teachings of the present disclosure.

FIG. 21 shows a lateral, hanging view of a mitt embodying teachings of the present disclosure. In the embodiment of the mitt described above, either one or both of the mitt faces (dorsal or ventral) or cuff flaps (dorsal or ventral) has a slit, opening, or pouch 26 over or through which something like a hook, bathroom hardware (faucet handle), or the nozzle of a pump bottle of washing soap may be placed, so that the slit takes the place of a ribbon loop for hanging the item to dry. The slit may be cut into the fabric and reinforced with stitching (similar to the common construction of a buttonhole) to make it unlikely to tear further open, or a pouch may be formed by attaching portions of the mitt body or cuff together 26. Note that while it is most likely that this pocket would be created in the proximal end of a mitt 2, it may also be created in a corner or edge of a washcloth, or other non-mitt cleansing textile.

Figure 22:
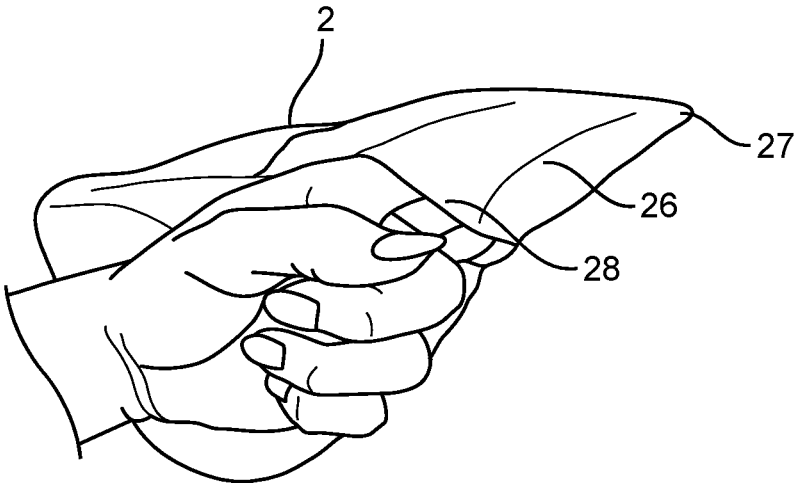
FIG. 22 shows a ventral view of a mitt embodying teachings of the present disclosure, with the user's index finger inserted into a pouch on the interior face of the proximal, ventral cuff of the mitt.

FIG. 22 shows a ventral view of a mitt embodying teachings of the present disclosure, with the user's index finger inserted into a pouch 26 on the interior face of the proximal 2, ventral cuff of the mitt. For an understanding of the shape and construction of this mitt, note that this mitt is the same mitt depicted in FIG. 14. Similar to the embodiment above, this embodiment involves a pouch or pocket that is integrated into the mitt body or the cuff of a mitt. The pouches or pockets could be on either the dorsal or ventral side, or both, and would most likely be placed on the mitt's lower peripheral end 2, close to where the hand is inserted. This pouch may be constructed so that it may be used independently of the larger washing surfaces of the mitt. This pouch 26 may be open on both the pouch's distal 27 and proximal 28 ends, or only open on the proximal end 28. In addition to enabling the mitt to be hung on an object to dry, the pocket or pouch may serve an additional cleansing function-one or more fingers can be inserted into the pouch in order to manipulate it around the user's skin or surface to be cleaned. In this way, the pouch material can be used to clean smaller, more delicate areas of skin, or areas that require very specialized cleansing, such as removal of makeup from the eyes. Additionally, this pouch may provide an easily unused, clean surface for areas to which the user desires to give special treatment, such as the eyes (which may be prone to bacterial infections, potentially from cleansing with "used," dirty fabrics) or ears. In this embodiment, the pouch can be made of a textile that suits the type of special cleansing desired, which may not be the same textile as the primary washing surfaces of the mitt. For example, the fabrics may be thin, smooth materials for use around the ears, or soft, "fuzzy" materials with napped surfaces for capturing particles of mascara that the user may want to remove from the eyelashes. This type of pouch provides numerous benefits to both the user and manufacturer. As previously mentioned in this document, loops that are sewn or attached to washcloths and mitts to be used to hang the items dry have a tendency to tear away from the item—it is difficult to secure small pieces of fabric securely to products. This type of pouch construction is much more durable than traditional ribbon loops, and can be manufactured to fit a larger variety of objects (for hanging it to dry) than traditional loops (which tend to be short for safety reasons). Additionally, small pouches for use over one or more fingers are not found on commercially available washing products, even though many individuals (and many inanimate objects) have tissues or body parts that benefit from gentle, specialized, targeted cleansing methods. Many consumers resort to single-use disposable products for specialized, detailed cleansing needs, and this feature may lead to a reduction in consumers' dependence on disposable products.

Figure 23:
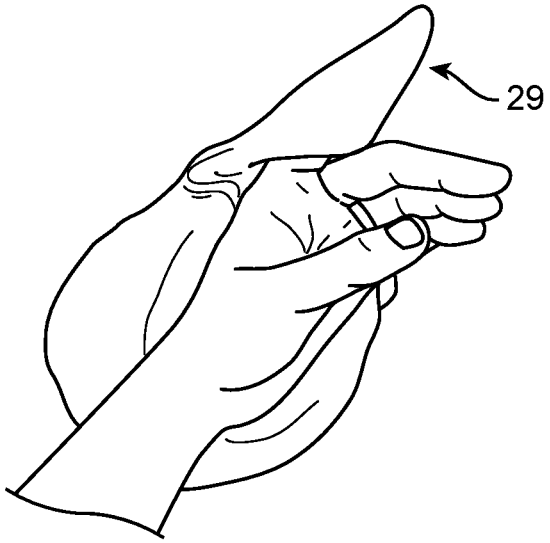
FIG. 23 shows a lateral, radial view of a mitt embodying teachings of the present disclosure, with the user's index finger inserted into a pouch on the interior face of the proximal, ventral cuff of the mitt.

FIG. 23 shows a lateral, radial view of a mitt embodying teachings of the present disclosure, with the user's index finger inserted into a pouch on the interior face of the proximal, ventral cuff of the mitt. As in the embodiment described above, the mitt may contain a pouch or pocket for specialized cleansing. Because eye makeup removal is a particularly useful application for this type of pouch, and because many types of eye makeup are darkly colored and tend to stain fabric, this pouch may be made of a darkly-colored material 29. In addition to lengthening the "life" of the product in the opinion of the user, darkly-colored materials have the added benefit of encouraging users to employ them for removing eye makeup. It is common for makeup wearers to use disposable products, such as cotton balls and disposable wipes, for removing pigmented cosmetics. One of the main reasons for this is that these types of makeup tend to stain fabrics, and users do not wish to "ruin" their linens. By making the pouch from a darkly-colored material, users will be encouraged to use it for the intended purpose, which will ultimately reduce the amount of disposable products entering landfills.

Figure 24:
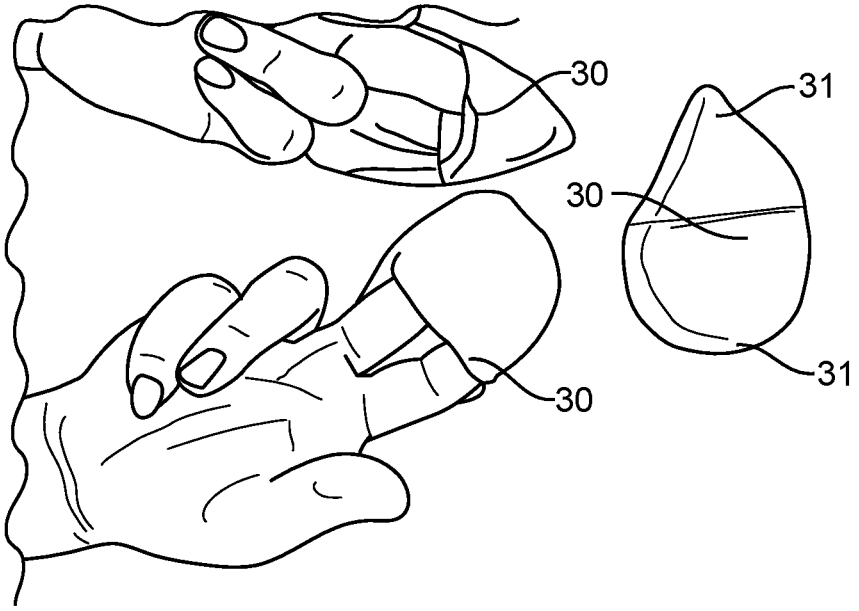
FIG. 24 shows a ventral view of three (essentially) identical embodiments of a mitt embodying teachings of the present disclosure, for the purposes of illustrating the potential construction and several (but not all of the) applications of this embodiment.

FIG. 24 shows a ventral view of three (essentially) identical embodiments of a mitt embodying teachings of the present disclosure, for the purposes of illustrating the potential construction and several (but not all) of the applications of this embodiment. The embodiment may be constructed to be of various sizes, with the salient feature being that the placement of the opening for fingers or hands is not at the lower periphery of the mitt, but rather, closer to the midpoint 30, between the longitudinal ends of the mitt 31, extending laterally, from the ulnar to radial side of the mitt 30. The longitudinal ends 31 are sewn closed, although it is possible that they could remain partially open to encourage airflow into the mitt for faster drying. While this opening 30 is likely close to the distal-proximal midpoint of the mitt, it may be closer to one longitudinal end than the other. Opposite either side of this midpoint opening, there is a small pouch for a finger, multiple fingers, or a hand. Note that in this version, the proximal end of the mitt is the midpoint opening, since the fingers can extend from this midpoint in either direction to either end of the mitt. In this way, either longitudinal end 31 of the mitt may be used for cleansing—the user may turn it around and insert the finger(s) or hand into the slit 30 facing the opposite direction from the original insertion, using a "fresh" end 31 for cleaning.

As previously discussed, any of the mitts described herein may be made from darkly-colored materials, in order to reduce the visibility of stains, and to encourage users to employ it for the removal of pigmented makeup, thus reducing their dependence on disposable, single-use products. Note that this embodiment of a mitt can employ more surface area for cleansing than comparable disposable products (cotton swabs or cotton balls), meaning it can remove more of the pigments the user desires to remove than a single unit of a comparable disposable product. Additionally, it can be made of a material that is softer and less likely to shed fibers than comparable disposable products. This means that the use of this mitt is less likely to result in irritating fibers being deposited in sensitive areas like the user's eyes than might occur with use of single-use, disposable products.

Figure 25:
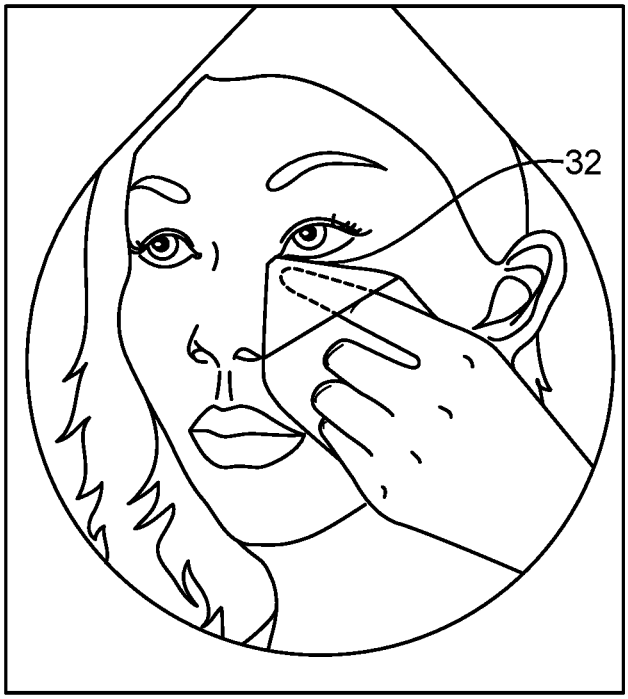
FIG. 25 shows a view of a mitt embodying teachings of the present disclosure, in an exemplary use.

FIG. 25 shows a view of a mitt embodying teachings of the present disclosure, in an exemplary use. This embodiment may be similar to the embodiment in FIG. 24. Note that the surface that was identified as "ventral" in FIG. 24 has been reversed in this drawing, and is now the dorsal surface. In this embodiment, the sides may be reversed with no deleterious impact on the usefulness of the mitt. Additionally, the longitudinal ends which extend away from the opening slit may be of different sizes and shapes, further increasing their practicality for cleansing differently-shaped areas of the body (e.g., one end sewn into a point for cleansing small areas 32, such as the area around the eyes, and the other end sewn into a larger curve for cleaning more uniform, flat areas of the face, such as the cheek surface area).

Referring back to FIG. 24, the pouches can be the same shape and size, or one can be smaller than the other, or they can be different both in size and shape. For example, one side can be rounded and the other can form more of a point. The purpose of these small pouches is to give the user multiple areas for cleaning delicate or small areas of the body, such as the outer ear folds, around the eyes, or between the neck folds of infants. This feature provides the user with a total of four potentially clean washing surfaces (each side of the mitt, dorsal and ventral, having two usable "halves" split by the midpoint opening). This embodiment does necessarily have a cuff, however, a cuff could be attached to the opening. Multiple textiles may be combined in the construction of the mitt, perhaps one for each of the four main washing surfaces, each having a particular cleansing function or benefit. Note that while four is a logical outside limit to the types of fabric contained by the mitt, it is conceivable that additional types of fabric may be added, as linings, trim, or to form additional sections or panels within any one of the four surfaces. And while the embodiment as described contains four washing areas, it may be constructed so as to contain more than four. The embodiment can be made of different fabrics, depending on the intended use. Because one desirable function of the pouch would be to remove eye makeup, and many types of eye makeup are darkly colored, the material of the mitt could be darkly colored, so as to resist showing stains. However, the mitt may also be made of other materials, such as a lighter-colored, stain-resistant material, which would provide the benefit of making the amount of colored makeup that has been removed more apparent to the user during use, yet would wash out easily when laundered.

Figure 26:
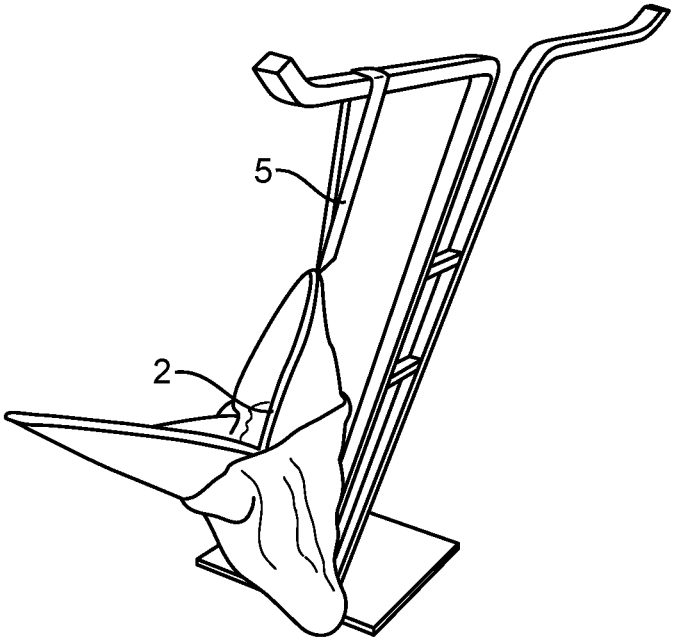
FIG. 26 shows a proximal, hanging view of a mitt embodying teachings of the present disclosure.

FIG. 26 shows a proximal, hanging view of a mitt embodying teachings of the present disclosure. In this embodiment of the mitt, a loop 5 is attached to or near the lowest peripheral edge 2 of the mitt or cuff, on either the dorsal or ventral side. This encourages the mitt to flop open when drying, since the weight of the opposing side (dorsal or ventral) pulls the mitt open when hung in this manner. Airflow into the mitt is thereby increased and drying time is reduced, thus decreasing the likelihood of undesirable bacterial growths and unpleasant smells.

Figure 27:
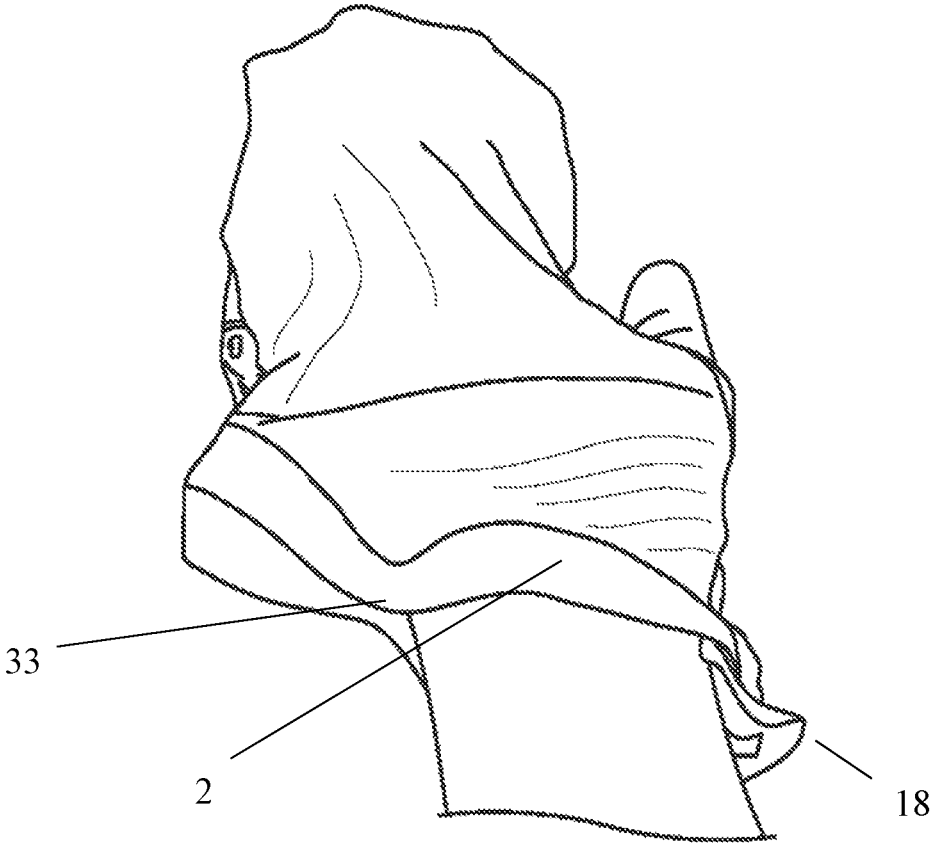
FIG. 27 shows a proximal, ventral view of a mitt embodying teachings of the present disclosure.

FIG. 27 shows a proximal, ventral view of a mitt embodying teachings of the present disclosure. This embodiment gives the benefit of adjustable sizing with the placement of a snap, hook, Velcro closure, or other attachment device 33 on either the radial or ulnar side of the lower peripheral edge 2 of the mitt. The closure(s) may be closer to the lower proximal end of the mitt, or it may be closer to the metacarpophalangeal joints, where the proximal ends of the fingers meet the palm. In this embodiment, the lowest peripheral edge of the mitt (where the hand enters) may not form a straight line, and is more likely to have a section that extends toward the wrist in its middle area (ulnar-to-radial edges), of the proximal end 18. The shape created by this edge may resemble a curve or angle. It may be a symmetrical curve, with the ulnar-radial mid-point reaching closer to the user's forearm when the mitt is worn, or the fabric may come to a point 18, forming a "V" with its single point stretching towards the user's forearm and the top points ending at the ulnar or radial edge seams of the mitt. The length of this curve or angle that is part of this lowest peripheral edge of the mitt from the lateral ulnar or radial edge, where the dorsal and ventral surfaces are attached, to the lowest proximal point on the dorsal or ventral sides 18 may be of a variety of lengths, for example one inch or five inches, depending on the particular pattern of the mitt. Snaps, hooks, Velcro closures, or other closing devices 33 may be placed on either or both of the lateral proximal sides of the curve or angle, at any point that is useful along these lower lateral/proximal edges. Users with larger hands may choose not to connect one (or more, if there are multiple) of the sides of the fabric with the closing devices 33, while users with smaller hands may choose to connect one or more of the closures 33 in order to fit the mitt more snugly on the hand. This method of cinching the lower peripheral end 2 around the proximal end of the hand serves the function of reducing manufacturing and end-user costs by limiting the number of distinct mitts that need to be produced and purchased, and by supplying a "one-size-fits-all" product that can fit multiple users, for example, multiple individuals within one household with differently-sized hands.

Further Embodiments of the Mitt that Are Not Illustrated

Another embodiment of a washing tool is a cloth formed by one or more pieces of textile or material, with multiple washing surfaces, distinguished by different textures, colors, thicknesses, coefficients of drag, or other distinct characteristics. For example, it may be made of a square or rectangle of fabric, however it could almost any other shape, that is made of one textile on either the dorsal or ventral surface, with a different textile on the alternate (dorsal or ventral) face. For example, same-sized squares of silk and cotton flannel could be sewn together on all sides, without an opening for a hand to enter. The purpose of the two textiles is to provide a variety of washing benefits to the user. Benefits include different textures for different types of skin cleansing, different coefficients of drag which allow the washcloth to adhere more to the user's hands than the skin that is being cleansed, different colors so the user can more easily distinguish the side that has been used, and a difference in the level of stain resistance, allowing the user to employ the more stain-resistant side on the area of the face that has a greater amount of stain-causing makeup to be removed, e.g., the eyes. In this example, two different textiles are employed, however, an almost endless variety of numbers and types of fabrics and shapes, conferring a variety of benefits, may be used in this type of product. Numerous benefits accrue from this configuration of a washing tool, including a reduction in the number of cleansing tools the user must own, and reduction in the number of distinct washing textiles that must be used and laundered as a result of a single washing session.

In an embodiment of the mitt with two separate flaps forming a cuff, the placement of the strap can result in increased airflow through the mitt during drying, reducing drying times. In this embodiment, the length of ribbon or strap material is not doubled over to create a loop, with the extreme points meeting at the same point for attachment to the mitt. In this embodiment, the ribbon fabric is allowed to extend, either to its fullest length or to any length where the end points do not actually meet. These extreme end points are then attached to the mitt either to the dorsal or ventral exterior or interior surface of the mitt, where the mitt's primary washing surface meets the cuff fabric (most likely, but not necessarily, a seam), or onto the exterior or interior dorsal or ventral area of the cuff, closer to the proximal, lowest peripheral end of the mitt. This placement of the ribbon causes the mitt to flop open when the ribbon is placed over a hook or other item, greatly increasing airflow and reducing drying time. Additionally, since the side of the mitt seam or cuff forms the other side of the opening used the hang the mitt to dry, this construction reduces the amount of ribbon material needed to create a usable loop. Also, by having a ribbon that is attached to the mitt at two distinct points, rather than one (as it would be in a typical hanging loop construction), the structural integrity of the ribbon attachments is increased, making them more likely to stay attached to the mitt after multiple launderings.

In one version, the loop may serve a decorative purpose, and is attached to the mitt, at or a few inches above the lowest peripheral end, either somewhere on the ventral or dorsal side, or either lateral (ulnar or radial) edge, and extending beyond the lower peripheral end, such that it resembles an animal's tail or the tail of a kite. In other iterations, there is no loop. By these means, the functional loop of fabric also serves a distinctive and decorative purpose.

Another embodiment of the mitt incorporates decorative features that improve airflow through the product, rather than impeding airflow. The decorative features found on many commercially available mitts are often bulky and involve additional layers of fabric, fillers, or trims, which have the impact of increasing drying times for the mitts after use and increasing the likelihood of bacterial growths. In this embodiment, the material forming the washing surface of the mitt is combined with sections of open-weave mesh fabric, or some other stretchy, highly breathable fabric (that is not necessarily optimal for washing skin). Alternately, the mitt is comprised of a washing glove, with separate pockets for fingers, with pieces of stretchy, breathable material sewn between each finger section. Note that while traditional gloves contain four finger compartments and one thumb compartment, the glove does not have to contain the traditional number of finger and thumb compartments. For example, it could contain two separate finger compartments (presumably designed to hold two fingers each), and one thumb compartment, or two finger compartments and no thumb compartment, or any other possible configuration of finger and thumb compartment divisions. Also, the mitt or glove could be created in many different sizes or patterns, many of which are described in this application. In this embodiment, the washing fabric and the mesh are patterned so that the mesh is primarily visible when the wearer expands the fingers away from each other laterally, making the hand's radial-to-ulnar distance greater than when the fingers are close to each other. In other words, the mesh sections become visible, accordion-style, when two or more fingers of the wearer are spread laterally apart. These sections can be decorated with designs, including animal faces, decorative shapes, or written messages, providing a "peekaboo" effect whenever the wearer extends one or more of the fingers away from the adjacent fingers. While these breathable sections would increase the overall amount of fabric comprising the mitt or glove, they would also increase the amount of airflow through the product, reducing or eliminating the impact of this extra fabric on the drying time of the mitt or glove after use.

Another embodiment of the mitt incorporating decorative features involves a mitt with openings near the topmost, distal end for one or more distal fingertips to protrude. These openings could be situated so that the protruding fingers appear to be animal ears, animal horns, or other decorative features. These holes would serve their decorative purpose while creating additional openings for airflow, reducing the product's drying time, and increasing the willingness of some children to be washed with this item or to use it themselves.

Another embodiment of a washing product involves a sponge or other somewhat rigid, porous object, covered in fabric that is appropriate for various types of facial or body cleansing. The structure of the interior sponge would essentially take the place of a user's finger, and could be much thinner, longer, more pointed, or more rounded than an individual's fingers or hands. The rigid quality of the sponge may allow the fabric-covered surface to reach the desired areas more efficiently than a user's finger, with a desirable combination of rigidity and "give," so that the user could employ the product in areas such as the outer or inner corners of the eyes with enough pressure to remove materials such as makeup, in a specific, detailed shape fitting the area to be cleansed, and with enough softness and "give" such that applying pressure removed debris without harming the area to be cleansed. The fabric covering the sponge would be of an appropriate type for the desired cleansing task (e.g., soft or napped for mascara removal), giving the user the benefits of the sponge's structure, in addition to the benefits of the fabric's softness or effectiveness at cleaning. The product could be manufactured such that the fabric could be removed for cleaning to tool, or so that the entire product could be laundered. Some of the benefits accruing from this embodiment of a cleansing tool include a reduction in the waste created by single-use disposable cleansing products, as this tool would take the place of many disposable products commonly employed for specialized personal cleansing functions (e.g., cotton swabs for ears or areas of the eyelids). Additionally, it could be constructed of materials that are softer than the commonly used disposable equivalents, and which do not shed, resulting in fewer instances of irritating fibers or debris being deposited on sensitive, easily irritated areas of the body (e.g., the eyes).

Another embodiment of the mitt involves features to help the mitt fit more snugly on a variety of hand sizes. One sizing feature employs a strap (presumably made of a stretchy material such as elastic, but not necessarily) attached to the proximal end of the mitt to help tighten the mitt around the hand or wrist. The strap would attach from one lateral edge of the mitt (ulnar or radial) and stretch to the other (essentially forming 180 degrees of a circle), or around the entire user's wrist (essentially forming a 360 degree circle). Some point at or near the distal end of the strap would cinch the strap around the user's wrist either by attaching the strap to itself on another point, or attaching the strap back onto the mitt by means of a button, snap, Velcro attachment, hook, or other device either placed on the body of the mitt, or on the strap, or on both, in the cases where the attaching devices contain two necessary parts (such as snaps).

Similar to the mitt with the midpoint opening shown by FIGS. 23 and 24, another embodiment of the mitt could contain distinct areas for individual fingers, however, it might contain more than the two ends depicted in FIG. 24. For example, one side could contain a pouch that comes to a point at the distal end, while the other end could contain multiple small pockets that could each hold one or more fingers, and that could move somewhat independently of each other during use. Another embodiment of this mitt could have an opening in the mid-point, from which multiple pouches radiate. For example, the opening could give the user access to multiple individual pouches (e.g., five, but it could be more or less), radiating like the arms of a star from the center. Each pouch could be used on a different day for eye makeup removal, providing the user with a single tool that contains multiple, easily distinguishable sections for different cleansing sessions or needs. Some of the benefits that would accrue from such a washing tool include decreasing the number of individual cleansing tools that must be stored or laundered by the user, decreasing the number of tools that need to be purchased, and a reduction in the use of disposable, single-use cleansing objects (such as cotton swabs or cotton balls) or disposable wipes.

Another embodiment of the mitt is similar to many described in this document, except that the ulnar and radial sides of the lower periphery of the mitt do not have closures or seams. Rather, one or both lateral sides of the lower periphery of the mitt have elastic, or some stretchy material, connecting points on the dorsal and ventral faces of the mitt. This elastic (or other material) stretches to fit the hand of the user, allowing the same mitt to fit a wide variety of hand sizes, thus increasing the usefulness of the single item for a variety of consumers. The elastic may vary in width from a small cord to an elastic piece an inch or two wide. The stiffness of the elastic, and the fact that the lower peripheral edges of the dorsal and ventral sides of the mitt are not actually sewn directly together, help prop the mitt open during drying, increasing airflow and reducing drying time.

Another embodiment of the product involves a mitt in which the cuff is made of a more rigid or thick material than the rest of the mitt. Examples of this fabric include neoprene or knitted fabric wrapped around "horsehair" linings. This type of cuff would tend to prop itself open, forcing the mitt into an oval or circle shape, instead of allowing the mitt to close in on itself, thus increasing airflow into the mitt and reducing drying time and simplifying the user's efforts to place the mitt on the hand when the hand or mitt is wet (since the presence of wetness tends to encourage fabric to adhere to skin, complicating users' efforts to place the mitt on the hand during use).

Another embodiment of the mitt places the ribbon for hanging the mitt to dry in a position that enables faster drying of the mitt. In this embodiment, the ribbon is attached to the interior of the mitt on either lateral (ulnar or radial) side, forming a line (more accurately, an elongated rectangle or other elongated shape, since the loop is not a pure geometric line, but length of fabric having some width in addition to length) that may be parallel to the lower peripheral end of the mitt. Alternately, this line may be placed at a different angle to the peripheral end of the mitt, such as at a 90-degree angle, in order to accommodate different types of drying hooks. Additionally, many of the embodiments of the mitt involve lower peripheral ends that are not at geometric right angles to the lateral edges of the mitt, which might make it difficult or impossible for the placement of the ribbon to form a parallel line. This placement of the loop increases the strength of the points of connection to the mitt, since there are two spots sewn into the mitt for connection, rather than a single one which must withstand all of the force of the mitt's weight and any tugging by the user when it is hung to dry. By placing the ribbon on the interior of the mitt, the mitt's dorsal and ventral sides are pulled apart, and the mitt tends to open, increasing airflow through the mitt and decreasing drying time.

Another embodiment of a washing product involves a cloth or piece of fabric that is constructed of one or more materials. In this version, the product may or may not be constructed as a mitt, with an opening for the hand to be inserted. It may also be a single piece of fabric of cut or sewn into a variety of shapes, e.g., small rounds. The salient feature is the different texture between the surface that is intended to be placed against the user's hands, and the washing surface, which would be exposed (and presumably placed on another part of the body or area to be cleansed)

when the product is placed against the user's hands. The interior or palmar surface of the mitt or cloth would have a greater coefficient of drag than the washing, exterior surface so that the cloth or mitt would adhere more to the user's hands than to the skin the user desires to clean. By giving the user greater "purchase" on the product, the construction may be simplified or altered in ways that confer other benefits, while still allowing the user a large degree over control over the movement of the product against the skin to be cleansed. This could be accomplished by the means of using two fabrics, attached or sewn together, so that one faces the palmar surface of the hand and one faces the skin to be cleansed. While it is assumed that the palmar surface of the hand is most useful for cleansing, some users may prefer to use the dorsal surface of the hand for cleansing, especially for cleansing the dorsal areas of the body, such as the back. The product may be reversed on the hand, dorsal-to-ventral side, without altering or negating the application of this embodiment. Another method of achieving varied coefficients of drag involves chemically or mechanically altering one surface of a material. Another method would be to apply a substance, such as silicone, rubber, or other "sticky" material, to the interior, palmar surface of the product. This substance could be applied as a thorough coating, or in dots, strips, or other shapes, which would have the effect of still allowing the material to breathe, which reduces the drying time after use. This embodiment confers many of the maneuverability benefits provided by a washing mitt, while reducing the manufacturing complexity and the related material costs. Additionally, this embodiment would allow the product to be used by a much broader group of users, since it would not need to fit closely to users' hands. Also it could be used by consumers who do not want the bulk or trouble of a mitt, yet who still find traditional washcloths to be difficult to maneuver.

LIST OF REFERENCE SIGNS AND THEIR RELEVANT FEATURES

1 Portion of mitt covering distal ends of fingers
2 Proximal, lower peripheral end of mitt
3 Proximal ends of fingers
4 Thumb slit
5 Ribbon or loop for hanging to dry
6 Ribbon placement in mitt interior, several inches above lower peripheral edge
7 Ribbon placement in mitt interior, approximately one inch above lower peripheral edge
8 Ribbon placement on outside of mitt
9 Ribbon secured around thumb
10 Darkly colored material
11 Ventral face of mitt
12 Dorsal face of mitt
13 Cuff
16 Radial-lateral edge of palm
17 Ulnar-lateral edge of palm
18 Lowest peripheral point (relevant for mitts with lower peripheral ends that are not formed by a single straight line from the lateral radial to ulnar lower peripheral edges)
19 Seam of cuff attachment to the mitt body
20 Interior surface of the mitt
21 Exterior surface of the mitt
22 "Wrong" side of fabric
23 Alternate fabric or substance with non-slip qualities
24 Dorsal-ventral side attachment
25 Asymmetrical cuff
26 Cuff pouch
27 Distal end of cuff pouch
28 Proximal end of cuff pouch
29 Pouch made of darkly-colored material
30 Opening at mid-point, rather than at lower peripheral-proximal end of mitt
31 Longitudinal ends of mitt
32 Mitt end formed into a point
33 Snap or other closure on lower peripheral end of mitt While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A multi-function washcloth mitt having an exterior, an interior pouch, and an opening from the interior pouch to the exterior;

wherein the mitt consists of two layers of different first and second fabrics, wherein the first fabric has a first side with a first coefficient of friction and a second side with a second coefficient of friction, the first coefficient of friction being greater than the second coefficient of friction;

wherein the first fabric is positioned on the exterior of the mitt with the second side on the exterior, and the second fabric lines the interior pouch of the mitt;

wherein the mitt is droplet-shaped such that one end of the mitt is a rounded end with a diameter which is equal to the width of the mitt, and the opposite end of the mitt is a pointed end, with a long axis which extends from the pointed end to a midpoint of the semicircular end; and wherein the opening is perpendicular to the long axis and is disposed midway along the long axis, dividing the interior pouch into two sections, the first section encompassing the pointed end of the mitt, and the second section encompassing the semicircular end of the mitt.

2. A washcloth mitt according to claim 1, wherein the second side of the first fabric is napped.

3. A washcloth mitt according to claim 1, wherein the second fabric is a woven fabric, such that when the first and second fabrics are wet and pressed against each other, the first and second fabrics are adapted to have a high enough coefficient of friction therebetween to permit a user to use the mitt as a washcloth without the user's fingers slipping within the mitt.

4. A washcloth mitt according to claim 1, further comprising:

a gather in middle of the mitt connecting dorsal and ventral sides of the mitt together, the gather extending through the interior pouch.

5. A washcloth mitt according to claim 1, wherein the mitt is fingerless.

6. A washcloth mitt according to claim 1, wherein there is only a single opening into the interior pouch.

7. A washcloth mitt according to claim 1, wherein the mitt defines a closed end opposite said opening, and further comprising:

a loop attached at an end opposite the closed end.

8. A washcloth mitt according to claim 7, wherein the loop is attached to the interior surface.

* * * * *